US005794390A

United States Patent [19]

Oliveri et al.

[11] Patent Number: 5,794,390

[45] Date of Patent: Aug. 18, 1998

[54] STRUCTURAL COVERING

[76] Inventors: Paul S. Oliveri, 828 Rensselaer Ave., Staten Island, N.Y. 10309; Camilo P. Messina, O'Gorman Ave., Staten Island, N.Y. 10306

[21] Appl. No.: 825,904

[22] Filed: Apr. 2, 1997

[51] Int. Cl.[6] ..... E04F 11/16; E04F 15/00

[52] U.S. Cl. ..... 52/177; 52/650.3; 52/736.3; 52/736.4; 52/737.4; 52/738.1; 52/256; 256/13.1; 256/1; 256/19

[58] Field of Search ..... 52/177, 650.3, 52/309.15, 736.3, 736.4, 737.4, 737.5, 738.1; 256/13.1, 1, 19; 424/77; 427/208; 43/114

[56] References Cited

U.S. PATENT DOCUMENTS

| | | | |
|---|---|---|---|
| 4,809,955 | 3/1989 | Veilleux | 256/19 X |
| 4,885,882 | 12/1989 | Forhsee | 52/738.1 X |
| 4,907,387 | 3/1990 | Turnbull | 52/177 |
| 5,070,664 | 12/1991 | Groh et al. | 52/177 |
| 5,143,418 | 9/1992 | Frouquet | 52/177 X |
| 5,326,187 | 7/1994 | St. Marie et al. | 52/738.1 X |
| 5,546,707 | 8/1996 | Caruso | 52/736.3 X |

*Primary Examiner*—Creighton Smith
*Assistant Examiner*—W. Glenn Edwards
*Attorney, Agent, or Firm*—Richard L. Miller, P.E.

[57] ABSTRACT

A structural covering that is attachable to a rail of a railing that has a top, a pair of sides, ends, and a bottom, and that is attachable to a floor board of a deck that has a top, a pair of sides, ends, and a bottom, while covering most of the rail of the railing and any exposed ends thereof and covering most of the floor board of the deck and any exposed ends thereof so as to prevent splinters, hide knots, splintered wood, discolored wood, and cracks in the wood, and give a uniform look that will not rot. The structural covering includes a general covering component, a connecting component, an end cap component, and a corner component. The general covering component covers most of the floor board of the deck and covers most of the rail of the railing. The connecting component joins facing ends of the general covering components that are adjacent and collinearlly-aligned. The end cap component covers any exposed end of the rail of the railing and any exposed end of the floor board of the deck and any free ends of the general covering component. And, the corner component joins facing ends of the general covering components that are adjacent and not collinearlly-aligned.

24 Claims, 2 Drawing Sheets

STRUCTURAL COVERING

BACKGROUND OF THE INVENTION

1. Field of the Invention

The present invention relates to a covering. More particularly, the present invention relates to a structural covering.

2. Description of the Prior Art

Railings, particularly on balconies and the like, are frequently made of wood. Wood is widely available and is easily worked, at least for upper rails, however, wood is not an ideal material. Even though painted or stained it weathers. Furthermore, it marks fairly easily and no finishes that can be applied really render wood completely wear resistant. In the circumstances people leaning on the rail or brushing against the rail, tend to mark it.

Numerous innovations for structural coverings have been provided in the prior art that will be described. Even though these innovations may be suitable for the specific individual purposes to which they address, however, they differ from the present invention.

FOR EXAMPLE, U.S. Pat. No. 4,723,758 to Gehrig teaches a safety covering for guide or guard rails that has a plastic element of bright material. Besides a contour corresponding to the guide rail front side to be covered, tabs for engaging the guide rail edges from behind are provided at the longitudinal edges. A special reflecting insert can augment the optical effect. Signal surfaces applied additionally on the safety coverings at an angle of less than 90 degrees can impart further optical information to drivers. By local application of such safety coverings on guide rails, optical traffic guidance can be enhanced and easily modified.

ANOTHER EXAMPLE, U.S. Pat. No. 5,299,883 to Arth, Jr. teaches a protective covering assemblage that is releasable secured to a post extending from the ground. Protection means are mounted on and supported by a top portion of the post so as to cover at least a portion of the post which would be grazed by a passing vehicle. The protection means are rotatable mounted on the post and are made from a material which avoids damaging a vehicle when the vehicle comes into contact with the protection means.

STILL ANOTHER EXAMPLE, U.S. Pat. No. 5,326,187 to St. Marie et al., as shown in FIG. 1, teaches a cover 10 to cover the upper rail 12 of a railing. The upper rail 12 has a top 14, a bottom 16, and sides 18. The cover 10 has a curved top 20 with a concave inner surface 22 to be positioned adjacent the top 14 of the rail 12 with longitudinal ribs 24 on the inner surface 22 thereof. Side walls 26 are positioned adjacent the sides 18 of the upper rail 12. Flanges 28 on the bottom 30 of the side walls 26 contact the bottom 16 of the rail 12 to locate the cover 10 on the rail 12.

Marie et al. poses many problems overcome by the present invention. For example, the longitudinal ribs 24 displace the curved top 20 from the top 14 of the rail 12 preventing the curved top 20 from being load bearing, if and when, used to cover a floor board. Next, the curved shape of the curved top 20 prevents stable standing thereon, if and when, used to cover a floor board. Another example, the curved top 20 being displaced from the top 14 of the rail 12 provides a space therebetween for insects to nest, as stated at col. 2 lines 62–63 of Marie et al.:

"In general the ribs . . . provide a space . . . "[Emphasis added]

And, finally but not last, premature failure thereof as a result of the need for deformation thereof to position it onto the rail 12, as stated at numerous occurrence in Marie et al., for example:

"The cover is . . . able to be distorted to fit over the rail . . . "[col. 1 lines 61–62 of Marie et al.] [Emphasis added];

"To use the embodiment of FIGS. 1 and 2 the cover 10 is distorted by gripping the flanges 24 and moving them outwardly, away from each other."[col. 2 lines 31–33 of Marie et al.] [Emphasis added];

"It is more difficult to distort the corner cap 26 to fit it in position and the ribs tend to . . . make distortion difficult." [col. 2 lines 48–50 of Marie et al.][Emphasis added]; and ". . . the cover [has] means for distorting to fit over the rail . . . "[claim 1 lines 11–13 of Marie et al.][Emphasis added].

YET ANOTHER EXAMPLE, U.S. Pat. No. 5,458,942 to Miller teaches a form-fitting covering for board fencing that includes a sheet of weather-resistant material which is folded to form a rectangular enclosure which envelopes a fencing board therein. Complementary fasteners are integrally formed at longitudinal edges of the sheet which are juxtaposed and interfitted after folding to maintain the enclosure in its rectangular shape. A two-part covering for a fencing post includes interfitting projections which maintain two juxtaposed sheets as an enclosure which envelopes a fencing post. A cap is provided over the top of the enclosure.

FINALLY, STILL YET ANOTHER EXAMPLE, U.S. Pat. No. 5,529,288 to Cheng-I teaches a structure of a handrail for a staircase including a rail formed with a first longitudinal groove at a lower side and a second longitudinal groove at an upper side, a plurality of supporters each having a curved connector, a wing portion connected with an end of the curved connector for slidably fitted into the longitudinal groove of the rail, and a tubular portion connected with another end of the curved connector, a base member fixedly secured to each of the supporters, a protective cap at both ends of the rail, a first U-shaped cover engaged with the first longitudinal groove of the rail, and a second U-shaped cover engaged with the second longitudinal groove of the rail.

It is apparent that numerous innovations for structural coverings have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a structural covering that avoids the disadvantages of the prior art.

ANOTHER OBJECT of the present invention is to provide a structural covering that is simple and inexpensive to manufacture.

STILL ANOTHER OBJECT of the present invention is to provide a structural covering that is simple to use.

BRIEFLY STATED, ANOTHER OBJECT of the present invention is to provide a structural covering that is attachable to a rail of a railing that has a top, a pair of sides, ends, and a bottom, and that is attachable to a floor board of a deck that has a top, a pair of sides, ends, and a bottom, while covering most of the rail of the railing and any exposed ends thereof and covering most of the floor board of the deck and any exposed ends thereof so as to prevent splinters, and hide knots, splintered wood, discolored wood, and cracks in wood, and give a uniform look that will not rot. The structural covering includes a general covering component, a connecting component, an end cap component, and a corner component. The general covering component covers most of the floor board of the deck and covers most of the rail of the railing. The connecting component joins ends of the general covering components that are adjacent and collinearlly-aligned. The end cap component covers any exposed end of the rail of the railing and any exposed end of the floor board of the deck. And, the corner component joins ends of the covering general covering components that are adjacent and not collinearlly-aligned.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Prior Art

10 cover

12 upper rail

14 top of upper rail 12

16 bottom of upper rail 12

18 sides of upper rail 12

20 curved top of cover 10

Figure 1:
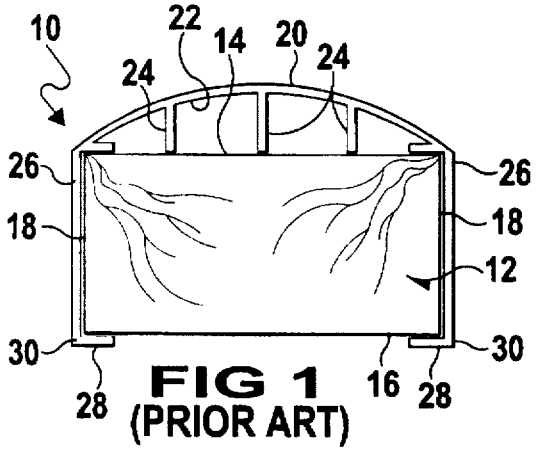
FIG 1 (PRIOR ART)
FIG. 1 is a diagrammatic cross sectional view of a prior art rail covering.

22 concave inner surface of curved top 20 of cover 10

24 longitudinal ribs on concave inner surface 22 of curved top 20 of cover 10

26 side walls of cover 10

28 flanges on bottom 30 of side walls 26 of cover 10

30 bottom of side walls 26 of cover 10

Preferred Embodiment

40 structural covering of the present invention

42 general covering component

44 floor board of deck 46

46 deck

47 screws

48 rail of railing 50

49 surface mounted shaped washers

50 railing 50

51 heads of the screws 47

52 connecting component

54 end cap component

56 corner component

58 top of general covering component 42

60 top of rail 48 of railing 50

62 pair of sides of general covering component 42

64 longitudinal edges of pair of sides 62 of general covering component 42

66 sides of rail 48 of railing 50

68 ends of general covering component 42

70 bottom of general covering component 42

71 top of connecting component 52

72 bottom of rail 48 of railing 50

74 pair of sides of connecting component 52

76 longitudinal edges of top 71 of connecting component 52

78 ends of connecting component 52

80 bottom of connecting component 52

82 top of end cap 54

84 pair of sides of end cap 54

86 longitudinal edges of pair of sides 84 of end cap 54

88 first end of end cap 54

90 second end of end cap 54

92 lateral edge of top 82 of end cap component 54

94 lateral edges 94 of pair of sides 84 of end cap component 54

96 bottom of end cap component 54

98 top of corner component 56

100 pair of sides of corner component 56

102 longitudinal edges of top 98 of corner component 56

104 ends of corner component 56

106 bottom of corner component 56

DETAILED DESCRIPTION OF THE PREFERRED EMBODIMENT

Figure 2:
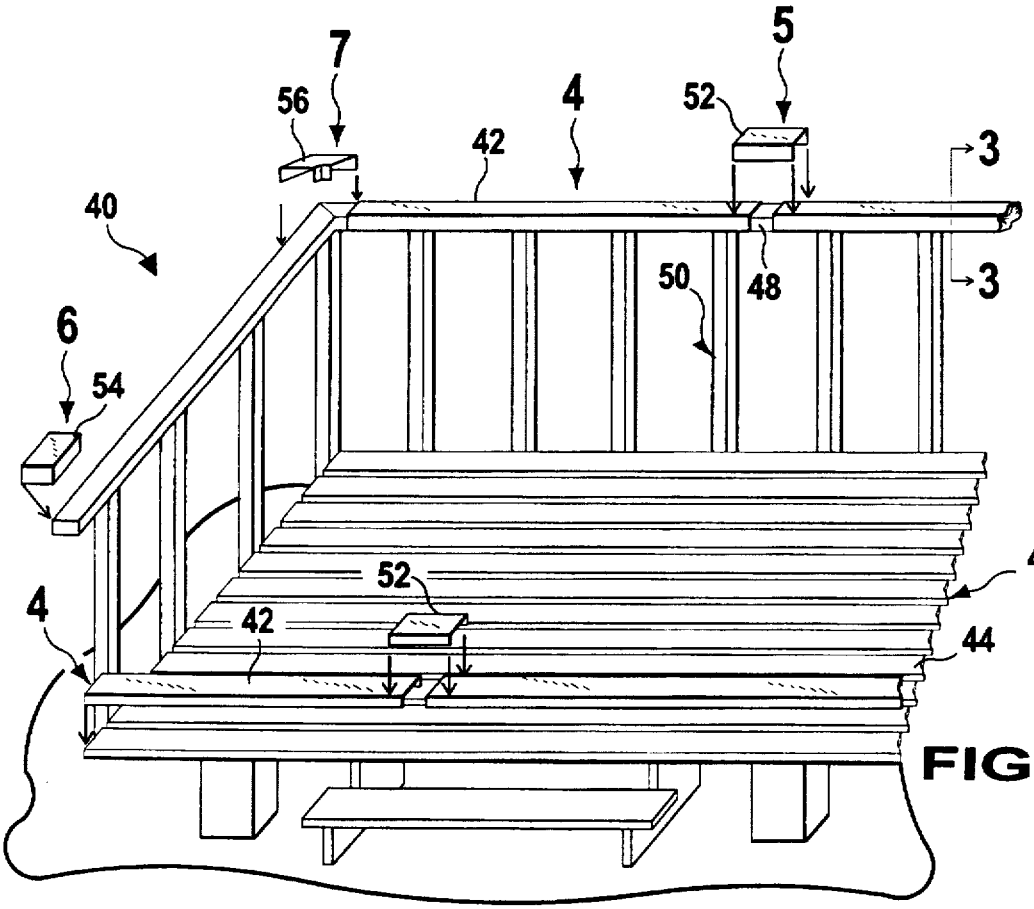
FIG. 2 is a diagrammatic perspective view of the present invention being utilized on a deck.

Referring now to the figures in which like numerals indicate like parts, and particularly to FIG. 2, the structural covering of the present invention is shown generally at 40 comprising a general covering component 42 for covering most of a floor board 44 of a deck 46 and for covering most of a rail 48 of a railing 50, a connecting component 52 for joining facing ends of general covering components 42 that are adjacent and collinearlly-aligned, an end cap component 54 for covering any exposed ends of the rail 48 of the railing 50 and for covering any exposed ends of the floor board 44 of the deck 46 and for covering any free ends of the general covering component 42, a corner component 56 for covering facing ends of the general covering components 42 that are adjacent and not collinearlly-aligned.

Figure 3:
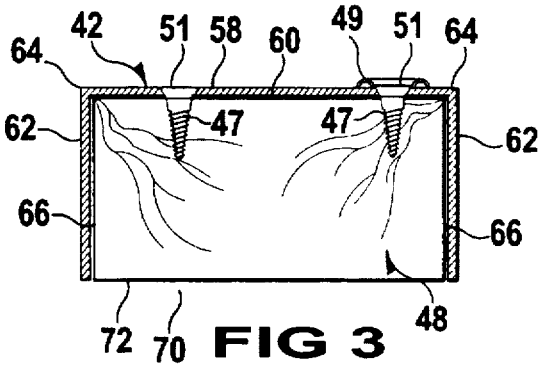
FIG. 3 is an enlarged cross sectional view taken on line 3—3 in FIG. 2.
Figure 4:
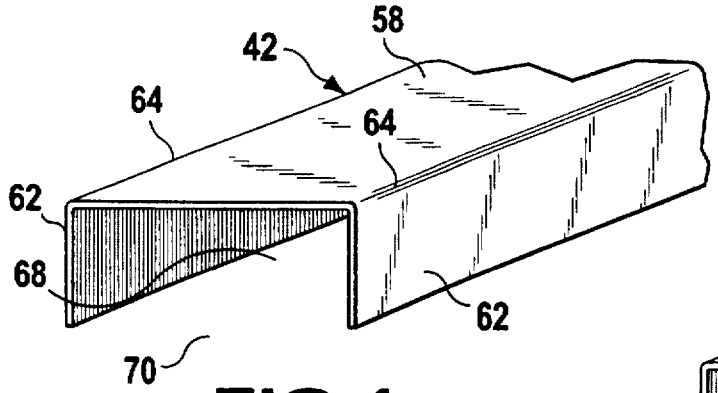
FIG. 4 is an enlarged perspective view, with parts broken away, taken generally in the direction of arrow 4 in FIG. 2.

The configuration of the general covering component 42 can best be seen in FIGS. 3 and 4, and as such will be discussed with reference thereto.

The general covering component 42 while not limited to may be typically fabricated out of preformed extruded plastic, elongated, and rectangular-parallelepiped-shaped. The general covering component 42 has a top 58 that is horizontally-oriented, flat, elongated, rectangular-shaped, and free of any inwardly-extending projections so as allow it to abut directly against a top 60 of the rail 48 of the railing 50 and to allow it to abut directly against a top of the floor board 44 of the deck 46 so as to eliminate any space therebetween. It is to be noted that other material are also substituted for fabricating all the various components and while not limited to include aluminum, carbon boron and fiber glass.

The general covering component 42 further has a pair of sides 62 that are vertically-oriented, flat, elongated, rectangular-shaped, and extend perpendicularly-downwardly from the top 58 of the general covering component 42 at its longitudinal edges 64, and which abut directly against sides 66 of the rail 48 of the railing 50 and which abut directly against sides of the floor board 44 of the deck 46. The pair of sides 62 of the general covering component 42 are free of any inwardly-extending projections at longitudinal edges thereof so as to eliminate a need for outward deformation thereof to position the general covering component 42 onto the rail 48 of the railing 50 and onto the floor board 44 of the deck 46 from above.

The general covering component 42 further has ends 68 that are open and clear ends of the rail 48 of the railing 50 and clear ends of the floor board 44 of the deck 46.

The general covering component 42 further has a bottom 70 that is open and clears a bottom 72 of the rail 48 of the railing 50 and clears a bottom of the floor board 44 of the deck 46 so as to allow the general covering component 42 to be positioned onto the rail 48 of the railing 50 and to be positioned onto the floor board 44 of the deck 46 without a need for deformation thereof by merely slipping it onto the rail 48 of the railing 50 and onto the floor board 44 of the deck 46 from above.

Figure 5:
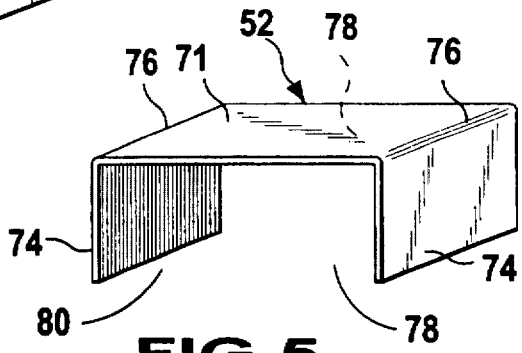
FIG. 5 is an enlarged perspective view, with parts broken away, taken generally in the direction of arrow 5 in FIG. 2.

The configuration of the connecting component 52 can best be seen in FIG. 5, and as such will be discussed with reference thereto.

The connecting component 52 is preformed extruded plastic and rectangular-parallelepiped-shaped. The connecting component 52 has a top 71 that is horizontally-oriented, flat, rectangular-shaped, and overlays and abuts directly against the tops 58 of adjacent and collinearlly-aligned general covering components 42 at facing ends 68 thereof while covering any gaps therebetween.

The connecting component 52 further has a pair of sides 74 that are vertically-oriented, flat, rectangular-shaped, and extend perpendicularly-downwardly from the top 71 of the connecting component 52 at its longitudinal edges 76, and which overlay and abut directly against the sides 62 of the adjacent and collinearlly-aligned general covering components 42 at the facing ends 68 thereof while covering any gaps therebetween. The pair of sides 74 of the connecting component 52 are free of any inwardly-extending projections at longitudinal edges thereof so as to eliminate a need for outward deformation thereof to position the connecting component 52 onto the rail 48 of the railing 50 and onto the floor board 44 of the deck 46 from above.

The connecting component 52 further has ends 78 that are open.

The connecting component 52 further has a bottom 80 that is open and clears a bottom 72 of the rail 48 of the railing 50 and clears a bottom of the floor board 44 of the deck 46 so as to allow the connecting component 52 to cover the adjacent and collinearlly-aligned general covering components 42 at facing ends 68 thereof without a need for outward deformation thereof by merely slipping it onto the facing ends 68 of the adjacent and collinearlly-aligned general covering components 42 from above.

Figure 6:
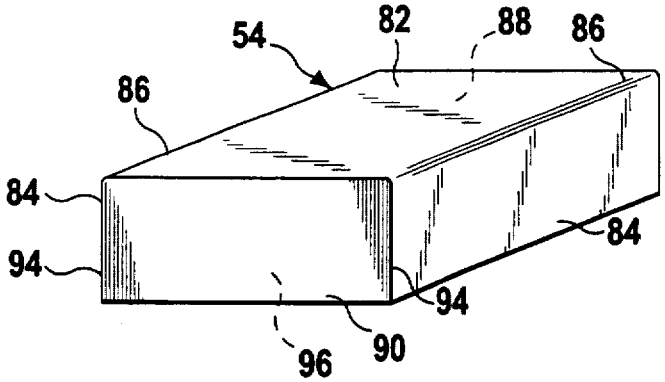
FIG. 6 is an enlarged perspective view, with parts broken away taken generally in the direction of arrow 6 in FIG. 2.

The configuration of the end cap component 54 can best be seen in FIG. 6, and as such will be discussed with reference thereto.

The end cap component 54 is preformed extruded plastic and rectangular-parallelepiped-shaped. The end cap component 54 has a top 82 that is horizontally-oriented, flat, rectangular-shaped, and overlays and abuts directly against the top 58 of the general covering component 42 at a free end thereof. The top 82 of the end cap component 54 is free of any interlocking projections so as to allow it overlay and abut directly against the top 58 of the general covering component 42 at the free end thereof.

The end cap component 54 further has a pair of sides 84 that are vertically-oriented, flat, rectangular-shaped, and extend perpendicularly-downwardly from the top 82 of the end cap component 54 at its longitudinal edges 86, and which overlay and abut directly against the sides 62 of the general covering component 42 at the free end thereof. The pair of sides 84 of the end cap component 54 are free of any interlocking projections so as to allow it to overlay and abut directly against the pair of sides 62 of the general covering component 42 at the free end thereof.

The end cap component 54 further has a first end 88 that is open.

The end cap component 54 further has a second end 90 that is vertically-oriented, flat, rectangular-shaped, and extends perpendicularly downwardly from the top 82 of the end cap component 54 at a lateral edge 92 thereof and perpendicularly connects the pair of sides 84 of the end cap component 54 at lateral edges 94 thereof that are coplanar with the lateral edge 92 of the top 82 of the end cap component 54, and which provides a stop when the end cap component 54 is positioned onto and overlays the free end of the general covering component 42 while covering the exposed end of the rail 48 of the railing 50 and covering the exposed end of the floor board 44 of the deck 46.

The end cap component 54 further has a bottom 96 that is open and clears the bottom 72 of the rail 48 of the railing 50 and clears the bottom of the floor board 44 of the deck 46 so as to allow the end cap component 54 to be positioned onto the free end of the general covering component 42 by merely slipping it onto the free end of the general covering component 42 from above.

Figure 7:
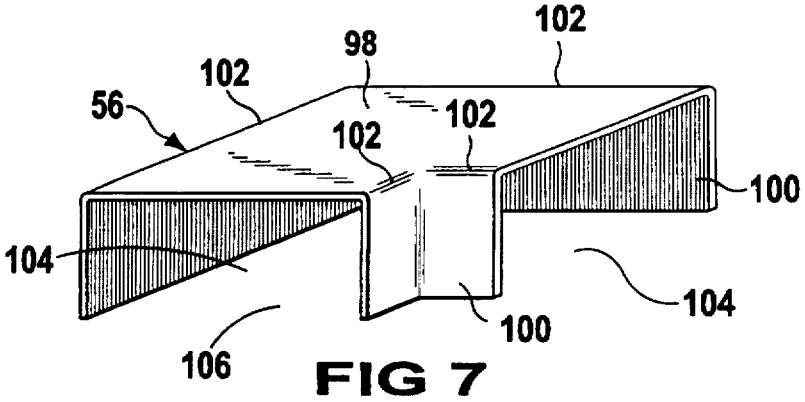
FIG. 7 is an enlarged perspective view, with parts broken away, taken generally in the direction of arrow 7 in FIG. 2.

The configuration of the corner component 56 can best be seen in FIG. 7, and as such will be discussed with reference thereto.

The corner component 56 is preformed extruded plastic and generally L-shaped. The corner component 56 has a top 98 that is horizontally-oriented, flat, generally L-shaped, and overlays and abuts directly against the tops 58 of adjacent and not collinearlly-aligned general covering components 42 at the facing ends 68 thereof while covering any gaps therebetween.

The corner component 56 further has a pair of sides 100 that are vertically-oriented, generally L-shaped, and extend perpendicularly-downwardly from the top 98 of the corner component 56 at its longitudinal edges 102, and which overlay and abut directly against the pair of sides 62 of the adjacent and not collinearlly-aligned general covering components 42 at the facing ends 68 thereof while covering any gaps therebetween. The pair of sides 100 of the corner component 56 are free of any inwardly-extending projections at longitudinal edges thereof so as to eliminate a need for outward deformation thereof to position the corner component 54 from above.

The corner component 56 further has ends 104 that are open.

The corner component 56 further has a bottom 106 that is open, generally L-shaped, and clears the bottoms 72 of the rails 48 of the railing 50 that are adjacent and not collinearlly-aligned so as to allow the corner component 54 to cover the adjacent and not collinearlly-aligned general covering components 42 at the facing ends 68 thereof without a need for outward deformation thereof by merely slipping it onto the adjacent and not collinearlly-aligned general covering components 42 from above.

The structural covering 40 can be attached to the rail 48 of the rail 50 and to the floor board 44 of the deck 46 in a number of ways consistent with its need for no deformation. For example, the structural component 40 can be attached to the rail 48 of the rail 50 and to the floor board 44 of the deck 46 by an adhesive that may contain insect repellant, such as but not limited to, termite repellant to increase the longevity of the rail 48 of the rail 50 and to increase the longevity of the floor board 44 of the deck 46. Another way is by use of a pressure sensitive tape which also may be impregnated with insect repellant. Another way, although not a final way, would be with the use of screws 47 and surface mounted and optional shaped washers 49 having recesses therein for receiving and recessing the heads 51 of the screws 47.

It will be understood that each of the elements described above, or two or more together, may also find a useful application in other types of constructions differing from the types described above.

While the invention has been illustrated and described as embodied in a structural covering, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A structural covering that is attachable to a rail of a railing that has a top, a pair of sides, ends, and a bottom, and that is attachable to a floor board of a deck that has a top, a pair of sides, ends, and a bottom, while covering most of the rail of the railing and any exposed ends thereof and covering most of the floor board of the deck and any exposed ends thereof, comprising:

a) a general covering component for covering most of the floor board of the deck and for covering most of the rail of the railing; said generally covering component having ends;

b) a connecting component for joining said ends of said general covering components that are adjacent and collinearlly-aligned;

c) an end cap component for covering any exposed end of the rail of the railing and for covering any exposed end of the floor board of the deck and for covering any free ends of said general covering component;

d) a corner component for joining facing ends of said covering general covering components that are adjacent and not collinearlly-aligned; and e) attaching means for attaching said structural component to the rail of the railing and to the floor board of the deck; said attaching means including a pressure sensitive tape whose adhesive is impregnated with an insect repellant.

2. The covering as defined in claim 1, wherein said general covering component is preformed extruded plastic, elongated, and rectangular-parallelepiped-shaped.

3. The covering as defined in claim 1, wherein said general covering component has a top that is horizontally-oriented flat, elongated, rectangular-shaped, and free of any inwardly-extending projections so as to allow it to abut directly against the top of the rail of the railing and to abut directly against the top of the floor board of the deck and eliminate any space therebetween.

4. The covering as defined in claim 3, wherein said general covering component further has a pair of sides that are vertically-oriented, flat, elongated, rectangular-shaped, and extend perpendicularly-downwardly from said top of said general covering component at its longitudinal edges, and which are abutable directly against the pair of sides of the rail of the railing and which are abutable directly against the pair of sides of the floor board of the deck; said pair of sides of said general covering component are free of any inwardly-extending projections at longitudinal edges thereof so as to eliminate a need for outward deformation thereof to position said general covering component onto the rail of the railing and onto the floor board of the deck from above.

5. The covering as defined in claim 1, wherein said general covering component further has ends that are open and clear the ends of the rail of the railing and clear the ends of the floor board of the deck.

6. The covering as defined in claim 1, wherein said general covering component further has a bottom that is open and clears the bottom of the rail of the railing and clears the bottom of the floor board of the deck so as to allow said general covering component to be positioned onto the rail of the railing and to be positioned onto the floor board of the deck without a need for deformation thereof by merely slipping it onto the rail of the railing and by merely slipping it onto the floor board of the deck from above.

7. The covering as defined in claim 1, wherein said connecting component is preformed extruded plastic and rectangular-parallelepiped-shaped.

8. The covering as defined in claim 4, wherein said connecting component has a top that is horizontally-oriented, flat, rectangular-shaped, and overlays and abuts directly against said tops of adjacent and collinearlly-aligned general covering components at the facing ends thereof while covering any gaps therebetween.

9. The covering as defined in claim 8, wherein said connecting component further has a pair of sides that are vertically-oriented, flat, rectangular-shaped, and extend perpendicularly-downwardly from said top of said connecting component at its longitudinal edges, and which overlay and abut directly against said pair of sides of said adjacent and collinearlly-aligned general covering components at said facing ends thereof while covering any gaps therebetween; said pair of sides of said connecting component are free of any inwardly-extending projections at longitudinal edges thereof so as to eliminate a need for outward deformation thereof to position said connecting component from above.

10. The covering as defined in claim 1, wherein said connecting component has ends that are open.

11. The covering as defined in claim 8, wherein said connecting component further has a bottom that is open and clears the bottom of the rail of the railing and clears the bottom of the floor board of the deck so as to allow said connecting component to be positioned onto said adjacent and collinearlly-aligned general covering components at said facing ends thereof without a need for outward deformation thereof by merely slipping it onto said facing ends of said adjacent and collinearlly-aligned general covering components from above.

12. The covering as defined in claim 1, wherein said end cap component is preformed extruded plastic and rectangular-parallelepiped-shaped.

13. The covering as defined in claim 4, wherein said end cap component has a top that is horizontally-oriented, flat, rectangular-shaped, and overlays and abuts directly against said top of said general covering component at a free end thereof; said top of said end cap component is free of any interlocking projections so as to allow it to overlay and abut directly against said top of said general covering component at said free end thereof.

14. The covering as defined in claim 13, wherein said end cap component further has a pair of sides that are vertically-oriented, flat, rectangular-shaped, and extend perpendicularly-downwardly from said top of said end cap component at its longitudinal edges, and which overlay and abut directly against said sides of said general covering component at said free end thereof; said pair of sides of said end cap component are free of any interlocking projections so as to allow it to overlay and abut directly against said pair of sides of said general covering component at said free end thereof.

15. The covering as defined in claim 13, wherein said end cap component further has a first end that is open so as to allow said end cap component to overlay and abut directly against said free end of said general covering component from above.

16. The covering as defined in claim 14, wherein said end cap component further has a second end that is flat, rectangular-shaped, and extends perpendicularly downwardly from said top of said end cap component at a lateral edge thereof and perpendicularly connects said pair of sides of said end cap component at lateral edges thereof that are coplanar with said lateral edge of said top of said end cap component, and which provides a stop when said end cap component is positioned onto said free end of said general covering component while covering the exposed end of the rail of the railing and covering the exposed end of the floor board of the deck.

17. The covering as defined in claim 13, wherein said end cap component further has a bottom that is open and clears the bottom of the rail of the railing and clears the bottom of the floor board of the deck so as to allow said end cap component to be positioned onto said free end of said general covering component without a need for outward deformation thereof by merely slipping it onto said free end of said general covering component from above.

18. The covering as defined in claim 1, wherein said corner component is preformed extruded plastic and generally L-shaped.

19. The covering as defined in claim 4, wherein said corner component has a top that is horizontally-oriented, flat, generally L-shaped, and overlays and abuts directly against said tops of said adjacent and not collinearlly-aligned general covering components at said facing ends thereof while covering any gaps therebetween.

20. The covering as defined in claim 19, wherein said corner component further has a pair of sides that are vertically-oriented, generally L-shaped, and extend perpendicularly-downwardly from the said top of said corner component at its longitudinal edges, and which overlay and abut directly against said pair of sides of said adjacent and not collinearlly-aligned general covering components at said facing ends thereof while covering any gaps therebetween; said pair of sides of said corner component are free of any inwardly-extending projections at longitudinal edges thereof so as to eliminate a need for outward deformation thereof to position said corner component from above.

21. The covering as defined in claim 1, wherein said corner component has ends that are open.

22. The covering as defined in claim 19, wherein said corner component further has a bottom that is generally L-shaped, open, and clears the bottoms of the rails of the railing that are adjacent and not collinearlly-aligned so as to allow said corner component to be positioned onto said adjacent and not collinearlly-aligned general covering components at said facing ends thereof without a need for outward deformation thereof by merely slipping it onto said adjacent and not collinearlly-aligned general covering components from above.

23. A structural covering that is attachable to a rail of a railing that has a top, a pair of sides, ends, and a bottom, and that is attachable to a floor board of a deck that has a top, a pair of sides, ends, and a bottom, while covering most of the rail of the railing and any exposed ends thereof and covering most of the floor board of the deck and any exposed ends thereof, comprising:

a) a general covering component for covering most of the floor board of the deck and for covering most of the rail of the railing; said generally covering component having ends;

b) a connecting component for joining said ends of said general covering components that are adjacent and collinearlly-aligned;

c) an end cap component for covering any exposed end of the rail of the railing and for covering any exposed end of the floor board of the deck and for covering any free ends of said general covering component;

d) a corner component for joining facing ends of said covering general covering components that are adjacent and not collinearlly-aligned; and e) attaching means for attaching said structural component to the rail of the railing and to the floor board of the deck; said attaching means including an adhesive impregnated with an insect repellant.

24. A structural covering that is attachable to a rail of a railing that has a top, a pair of sides, ends, and a bottom, and that is attachable to a floor board of a deck that has a top, a pair of sides, ends, and a bottom, while covering most of the rail of the railing and any exposed ends thereof and covering most of the floor board of the deck and any exposed ends thereof, comprising:

a) a general covering component for covering most of the floor board of the deck and for covering most of the rail of the railing; said generally covering component having ends;

b) a connecting component for joining said ends of said general covering components that are adjacent and collinearlly-aligned;

c) an end cap component for covering any exposed end of the rail of the railing and for covering any exposed end of the floor board of the deck and for covering any free ends of said general covering component;

d) a corner component for joining facing ends of said covering general covering components that are adjacent and not collinearlly-aligned; and e) attaching means for attaching said structural component to the rail of the railing and to the floor board of the deck; said attaching means including screws with heads and surface mounted and shaped washers with recesses therein for receiving and recessing said heads of said screws.

* * * * *